US006899510B2

(12) United States Patent
Morelli et al.

(10) Patent No.: US 6,899,510 B2
(45) Date of Patent: May 31, 2005

(54) PIPE HANDLING SYSTEM FOR PRESENTING SECTIONS OF PIPE TO A DERRICK WORK FLOOR HAVING A PIPE EJECTION ASSEMBLY

(75) Inventors: Vince E. Morelli, Red Deer (CA); Richard Arnold Handley, Red Deer (CA); Darren Shiels, Red Deer (CA); Jason Klumpenhower, Sylvan Lake (CA)

(73) Assignee: Pipe Wranglers Canada (2004) Inc., Red Deer (CA)

( * ) Notice: Subject to any disclaimer, the term of this patent is extended or adjusted under 35 U.S.C. 154(b) by 222 days.

(21) Appl. No.: 10/418,718

(22) Filed: Apr. 18, 2003

(65) Prior Publication Data

US 2004/0208738 A1 Oct. 21, 2004

(51) Int. Cl.[7] ..... B66F 11/00; E21B 19/00

(52) U.S. Cl. ..... 414/745.8; 414/22.61; 414/22.65

(58) Field of Search ..... 414/745.1, 745.8, 414/746.8, 22.57, 22.58, 22.65, 22.61

(56) References Cited

U.S. PATENT DOCUMENTS 4,235,566 A * 11/1980 Beeman et al. ..... 414/22.61
4,386,883 A * 6/1983 Hogan et al. ..... 414/22.61
4,426,182 A * 1/1984 Frias et al. ..... 414/22.61
4,453,872 A * 6/1984 Frias et al. ..... 414/22.61
4,470,740 A * 9/1984 Frias ..... 414/22.61
4,474,520 A * 10/1984 Buckner et al. ..... 414/22.61
4,494,899 A * 1/1985 Hoang et al. ..... 414/22.61

* cited by examiner

*Primary Examiner*—Gene O. Crawford
(74) *Attorney, Agent, or Firm*—Gowling Lafleur Henderson, LLP; D. Doak Horne

(57) ABSTRACT

A pipe handling apparatus for raising and lowering pipe to and from a raised derrick work floor. The apparatus comprises a longitudinally-extending base, with a longitudinally-extending cavity therein. An elongate, longitudinally-extending boom member is provided, which is adapted for raising out of and nestable positioning in such cavity. The boom member has a longitudinally-extending trough therein on an upperside surface thereof, adapted to receive at least one section of pipe. At least one arm member is coupled to the boom member for raising a proximal end of such boom member. A pipe ejection assembly, integrated into said boom, is operable as the boom lowers into the cavity for the purpose of laterally ejecting pipe from the trough. The ejection assembly is adaptable for uni-directional or bi-directional ejection. Motive means are provided to permit powered movement of the ejector members when the boom is nested.

18 Claims, 9 Drawing Sheets

PIPE HANDLING SYSTEM FOR PRESENTING SECTIONS OF PIPE TO A DERRICK WORK FLOOR HAVING A PIPE EJECTION ASSEMBLY

FIELD OF THE INVENTION

The invention relates generally to pipe handling systems and in particular to an apparatus for providing drill pipe to, and receiving drill pipe from, the work floor of a derrick or rig.

BACKGROUND OF THE INVENTION

Drill strings of pipe for oil and gas wells are assembled or disassembled vertically on a derrick one joint at a time, and are stored horizontally on pipe racks situated on the ground adjacent the rig. The work floor of the rig is typically elevated substantially above the pipe rack such that transferring sections of pipe to and from the work floor and the racks is necessary and requires careful handling of the heavy pipe to protect the workers and the pipe.

Conventional systems based on a boom having a pipe receiving trough in which pipe may be placed typically also include some way to eject sections of pipe out of such trough.

A variety of ejection mechanisms are known for removing pipe from a trough. For example U.S. Pat. No. 4,371,302 to Frias et al ('302') teaches a means for tilting an entire trough in a boom assembly that does not itself rise to the derrick work floor but merely feeds a second boom one end of which is pivotally coupled to the work floor. Disadvantageously, tilting an entire trough or boom requires significantly more power and compromises the potential rigidity of the boom more than is necessary when a short kicker member or section of trough is tilted to the same effect.

U.S. Pat. No. 3,143,221 to Blackmon ('221') teaches a pipe car pulled and released by a cable and having 2 sets of side-mounted wheels each set having a common axle and running in a channel in a fixed track, with a v-shaped carriage member that tilts to either side of the pipe car in a manner similar to the tilting car of U.S. Pat. No. 24,907 to Maydew ('907'). Disadvantageously all known car designs run in a stationary track and require separate power and trigger assemblies.

U.S. Pat. No. 4,235,566 to Beeman ('566') teaches a dump arm pivotally connected to a boom and fastened to an hydraulic ram that is connected to the boom, such configuration disadvantageously adds weight and complexity to the boom.

Applicant's Canadian application CA 2224638 teaches a number of embodiments of a kicker together with a kicker rod. However, such design necessarily uses power and trigger assemblies that are separate from the boom.

The prior art in the oil-field service industry has concentrated on teaching variations on power driven tilting troughs and hydraulically powered kickers mounted on the boom or on the base and relying on a separate source of the power needed to cause ejection. None of the prior art, however, teaches an ejector that uses passive actuator members and is operable without a separate trigger and source of power to cause the ejecting motion.

SUMMARY OF THE INVENTION

The apparatus of the present invention provides passive means for ejecting pipe from the trough of a boom by using the weight of the boom itself as the source of ejection force. This efficient implementation of an integrated "kicker" ejection apparatus may be combined with conventional hydraulic or pneumatic technologies for increased flexibility of operation.

Accordingly, in a broad aspect of the present invention there is provided a pipe handling apparatus capable of laterally ejecting pipe, the apparatus having a base, the base having a longitudinally extending cavity therein, the apparatus further having longitudinally extending boom having a distal end and a proximal end, a first side and a second opposing side, and a longitudinally extending trough for receiving at least one section of pipe, further comprising: a first ejector pivotally coupled to the first side of the boom; a second ejector, longitudinally separated along the boom from the first ejector and pivotally coupled to the first side of the boom; an actuator shaft assembly situate below and substantially parallel to the boom movably coupled to the base, the actuator shaft assembly has an actuated position and means for moving the actuator shaft assembly to its actuated position in order to enable substantially simultaneous activation of the first and second ejectors so as to cause the pipe to be ejected from the first side of the boom.

In a refinement of the present invention there is further provided: a third ejector, situate proximate the first ejector, pivotally coupled to the second opposing side of the boom, the first and second ejectors forming a first ejector pair; and a fourth ejector, situate proximate the second ejector, pivotally coupled to the second side of the boom, the third and fourth ejectors forming a second ejector pair; the actuator shaft assembly having a first actuated position and a second actuated position, together with means for moving the actuator shaft assembly between the first and second actuated positions; wherein the actuator shaft assembly may be moved to the first actuated position to activate the first ejector pair so as to eject pipe from the first side of the boom and may be moved to the second actuated position to activate the second ejector pair so as to eject pipe from the second side of the boom.

The invention comprises a number of configurations for the actuator shaft assembly.

In a first embodiment, the actuator shaft assembly comprises: an elongate shaft member; a first actuator member extending radially from the shaft member and the first actuator member is substantially in longitudinal alignment with the first ejector; and a second actuator member extending radially from the shaft member and the second actuator member is substantially in longitudinal alignment with the second ejector; whereby, when the actuator shaft assembly is operated to the actuated position the first actuator member can engage the first ejector and substantially simultaneously the second actuator member can engage the second ejector.

According to an alternate implementation, the actuator shaft assembly comprises: an elongate shaft member; a pair of first actuator members extending radially from the shaft member and substantially in alignment respectively with the first and second ejectors of the first ejector pair; and a pair of second actuator members extending radially from the shaft member and substantially in alignment respectively with the first and second ejectors of the second ejector pair; wherein the elongate shaft member may be moved to a position whereby the pair of first actuator members engage respectively the first and second ejectors of the first ejector pair so as to eject pipe from the first side of the boom, and the elongate shaft member may be moved to a position whereby the pair of second actuator members engage respectively the first and second ejectors of the second ejector pair so as to eject the pipe from the second side of the boom.

According to an alternate implementation, the actuator shaft assembly comprises: an elongate shaft member; a pair of first actuator members extending radially from the shaft member and substantially in alignment respectively with the first and second ejectors of the first ejector pair; and a pair of second actuator members extending radially from the shaft member and substantially in alignment respectively with the first and second ejectors of the second ejector pair; wherein the elongate shaft member may be moved to a position whereby the pair of first actuator members engages respectively the first and second ejectors of the first ejector pair so as to, when the boom is lowered into the cavity, eject pipe from the first side of the boom, and the elongate shaft member may be moved to a position whereby the pair of second actuator members engages respectively the first and second ejectors of the second ejector pair so as to, when the boom is lowered into the cavity, eject the pipe from the second side of the boom.

In yet a further, alternate embodiment, the actuator shaft assembly comprises: a first elongate shaft member having a first actuator member extending radially therefrom and substantially in longitudinal alignment with the first ejector; a second actuator member extending radially from the first elongate shaft member and substantially in longitudinal alignment with the second ejector; a second elongate shaft member having a third actuator member extending radially therefrom and substantially in longitudinal alignment with the third ejector; and a fourth actuator member extending radially from the second elongate shaft member and substantially in longitudinal alignment with the fourth ejector; wherein the first elongate shaft member may be moved to a position whereby the first actuator member engages the first ejector and substantially simultaneously the second actuator member engages the second ejector, so as to eject pipe from the first side of the boom, and alternatively the second elongate shaft member may be moved to a position whereby the third actuator member engages the third ejector and substantially simultaneously the fourth actuator member engages the fourth ejector, so as to eject pipe from the second side of the boom.

According to yet a further alternate implementation, the actuator shaft assembly comprises: a first elongate shaft member having a first actuator member extending radially therefrom and substantially in longitudinal alignment with the first ejector; a second actuator member extending radially from the first elongate shaft member and substantially in longitudinal alignment with the second ejector; a second elongate shaft member having a third actuator member extending radially therefrom and substantially in longitudinal alignment with the third ejector; and a fourth actuator member extending radially from the second elongate shaft member and substantially in longitudinal alignment with the fourth ejector; wherein the first elongate shaft member may be moved to a position whereby the first actuator member engages the first ejector and substantially simultaneously the second actuator member engages the second ejector, so as to, when the boom is lowered into the cavity, eject pipe from the first side of the boom, and alternatively the second elongate shaft member may be moved to a position whereby the third actuator member engages the third ejector and substantially simultaneously the fourth actuator member engages the fourth ejector, so as to, when the boom is lowered into the cavity, eject pipe from the second side of the boom.

In a further refinement of the apparatus as a whole having a first ejector pair, the first and second ejector of the first ejector pair comprises: pivot means for pivotally coupling the first ejector pair to the first side of the boom; and a receiver assembly coupled to the cradle for engaging one actuator member of the pair of first actuator members; wherein each receiver assembly of the first ejector pair is positioned, shaped, and sized so as to enable the pair of first actuator members to substantially simultaneously activate the first and second ejectors of the first ejector pair.

In an alternate embodiment of the apparatus having a first and second ejector pair, each of the first and second ejector of the second ejector pair comprises: pivot means for pivotally coupling the ejector to the second side of the boom; and a receiver assembly coupled to the cradle for engaging one actuator member of the pair of second actuator members; wherein each receiver assembly of the second ejector pair is positioned, shaped, and sized so as to enable the pair of second actuator members to substantially simultaneously activate the first and second ejectors of the second ejector pair.

In a further aspect of the present invention, a cradle member is provided, each cradle member having a generally v-shaped cross-section further having a cradle surface situated co-planar with and conforming to the trough, the cradle member laterally extending across an opening in the trough between first and second sides thereof, the cradle member having a first edge and a second edge respectively substantially coincident with the first and second sides of the boom, the cradle member pivotally coupled, by the pivot fastened on one of the first or second edges of the cradle member, to one side of the boom for permitting the ejector to pivot about one side of the boom so as to allow pipe contacting the cradle surface to exit the trough when the ejector pair is activated.

In a further refinement, each pivot for pivotally coupling an ejector to the boom comprises: a pivot tube connected to one of the first or second edges of the cradle member; at least one fixed tube fastened to one side of the boom situate proximate to and axially aligned with but longitudinally displaced from the pivot tube, and a pivot pin positioned on a common axis so as to releasably couple the pivot tube to the at least one fixed tube, about which pin the attached ejector can pivot transversely relative to the boom.

Each receiver assembly, in a preferred embodiment, comprises a rigid surface against which a respective actuator member may be engaged so as to permit the application of force to the rigid surface in order to cause the first and second ejector to respectively pivot transversely relative to the boom, each rigid surface being situated, oriented, shaped, and sized so as to enable the pair of first actuator members to substantially simultaneously pivot the first and second ejectors of the first ejector pair.

In a preferred embodiment of the invention, the actuator member comprises an elongate cam relatively situated, oriented, shaped, and sized so as to transmit force against a receiver assembly for the purpose of substantially simultaneously activating a pair of ejectors. Each elongate cam comprises a coupling end and an opposing striking end having there between a retractably telescoping member for moving the striking end radially towards and away from the actuator shaft member, for the purpose of enabling the activation of ejectors while the boom is nested in the cavity.

According to different implementations of the apparatus of the present invention the movement of an actuator shaft member may be rotational or longitudinally slidably. Further, the means to assist the movement of an actuator shaft member include but are not limited to any suitable manual crank or power (e.g. electric, hydraulic, pneumatic) driven ram or gearing assembly.

BRIEF DESCRIPTION OF THE DRAWINGS

The present invention, in order to be easily understood and practised, is set out in the following non-limiting examples shown in the accompanying drawings, in which.

DETAILED DESCRIPTION OF THE PREFERRED EMBODIMENT

Reference is to be had to FIGS. 1–10 in which identical reference numbers identify similar components.

Figure 1:
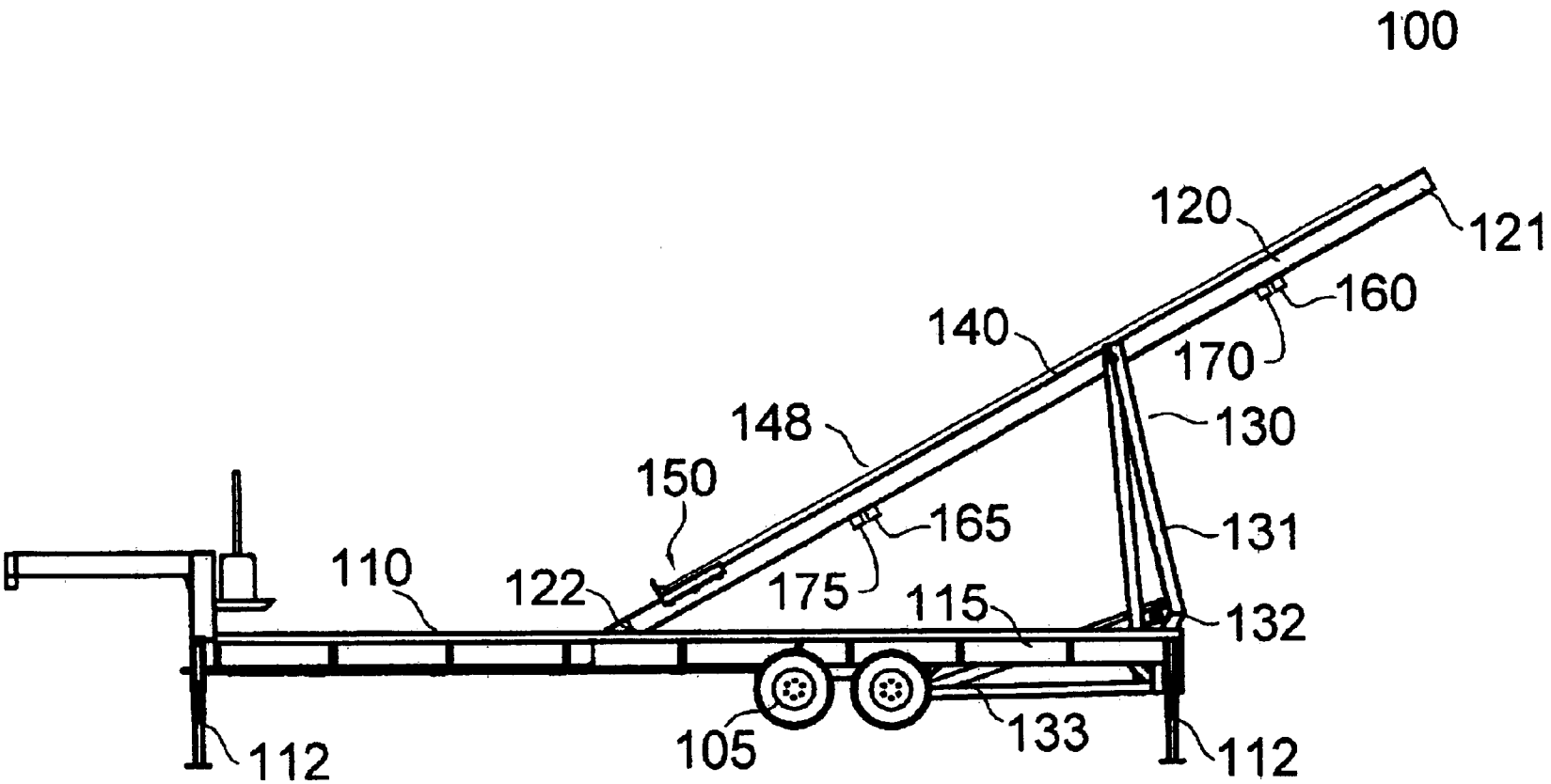
FIG. 1 is a side view of a mobile version of the apparatus of the present invention.

Referring to FIG. 1 there is illustrated one embodiment of a pipe handling system, denoted generally as 100 shown having base 110 mounted on undercarriage assembly 105 stabilized by legs 112 when in operation. Boom 120 is shown with proximal end 121 in a raised position moving toward a derrick work floor (not shown) with distal end 122 gliding along cavity 115 guided by track means (not shown), as actuating means 130 raises boom 120 out of cavity 115. Trough 140, having pipe 148 therein, extends longitudinally along boom 120 and may be formed therein or fastened thereon, but in either case trough 140 is adapted for having ejectors 160, 165, 170, and 175 mounted therein, as well as for receiving carriage assembly 150 adapted to be driven bi-directionally between the distal end 122 and the proximal end 121 of boom 120. As shown, carriage assembly 150 carries the distal end of pipe 148. The proximal end 121 of boom 120 is raised by any suitable actuating means 130, one embodiment of which comprises pivoting arm 131 and suitable linkage 132 actuated by hydraulic ram 133, for the purpose of receiving pipe 148 into trough 140 from the rig floor for further handling, typically returning same to the racks. To return from the rig floor to ground, pipe 148 is lowered into receiving area 215 (see FIG. 2) of carriage assembly 150 (while positioned at proximal end 121 of boom 120 at the level of the rig floor) until pipe 148 comes to rest against pipe engaging member 220 on carriage assembly 150. Actuating means 130 then lowers boom 120 with pipe 148 therein, such that in its fully lowered or "laid down" position boom 120 nests inside cavity 115 in base 110. Depending upon the position of actuator shaft 310 (see FIG. 3), as boom 120 nests in cavity 115 ejectors 160 and 165 can engage actuator members 350 and 355 respectively or ejectors 170 and 175 can engage actuator members 370 and 375 (see FIG. 4) respectively. Although base 110 is shown in a mobile embodiment having any suitable undercarriage assembly 105, a person of skill in the art would understand that base 110 may also be of the stationary variety.

It is further contemplated that the distal end 122 of boom 120 may be also raised to the level of work floor 16 by any suitable actuating means similar to actuating means 130 (one embodiment of which comprises pivoting arm 131 and suitable linkage 132 actuated by hydraulic ram 133) for the purpose of better leveling trough 140 during either a pickup or lay down sequence. For example, according to the embodiment of the present invention illustrated in FIG. 9 pivoting leg assembly 10 comprises a leg member 104 having one end adapted for releasable coupled engagement with distal end 122 of boom 120, and an opposing end pivotally connected to stationary base 12 at any suitable location by any suitable connection means 103. Releasable coupled engagement between leg member 104 and the distal end 122 of boom 120 is achieved in a preferred embodiment by complementary engaging means 102*a* and 102*b* (seen in a sequence of close-up side views in FIG. 10) that each comprise an assembly of interdigitating slots and rods, but numerous other configurations permitting releasable coupleable engagement, whereby the end of the leg member 104 is releasably coupled to distal end 122 of boom 120, will be readily apparent to those skilled in the art. Engaging means 102*a* is situate on one end of leg member 104 an opposing end thereof pivotally connected by connection means 103 to stationary base 12. Complementary engaging means 102*b* is situate on the distal end 122 of boom 120 in longitudinal axial alignment with engaging means 102*a* for the purpose of permitting engaging means 102*a* to releasably engage engaging means 102*b* as boom 120 moves proximally towards leg member 104, such that as boom 120 moves longitudinally in response to operation of lift means 106, leg member 104 either engages or disengages (depending upon direction) the distal end 122 of boom 120 in releasable coupled engagement.

Figure 9:
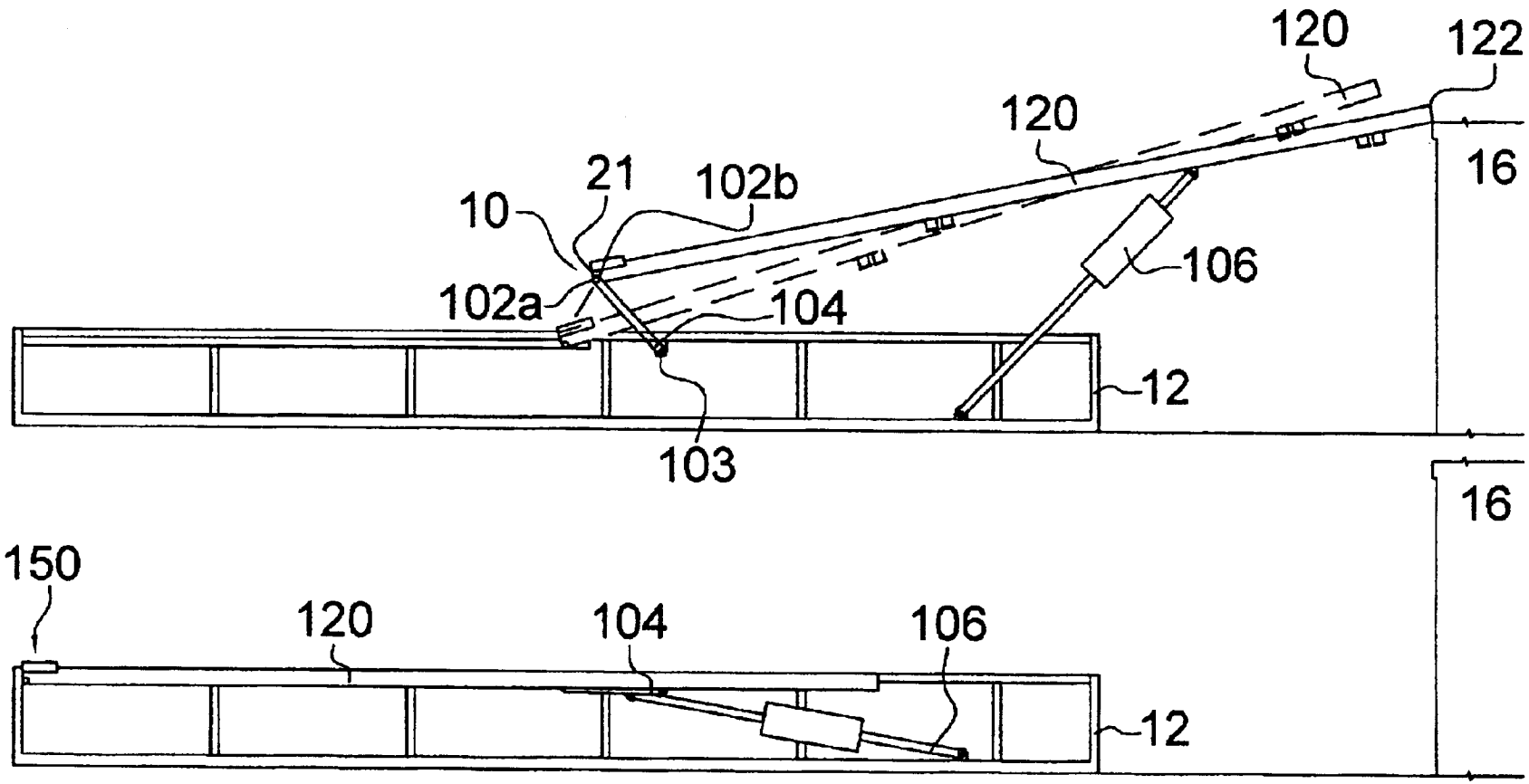
FIG. 9 is a side view of one embodiment of a distal arm assembly of the apparatus of the present invention.
Figure 10:
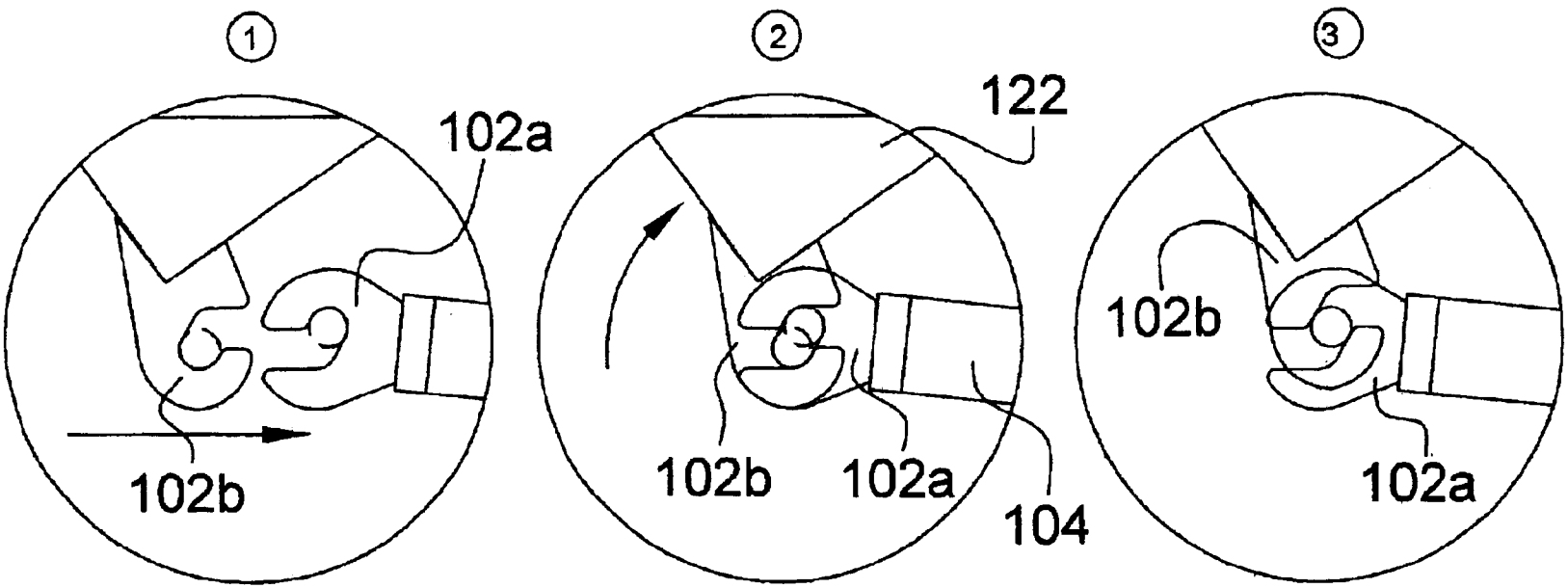
FIG. 10 is a close-up side view of one embodiment an assembly of interdigitating slots and rods of the apparatus of the present invention.

Referring to FIG. 10, once releasable coupled engagement occurs between engaging means 102*a* and 102*b* (ref. FIG. 9), according to a preferred embodiment they further lockingly engage as their mating assemblies of interdigitating slots and rods rotate relative to one another, which rotation occurs upon the pivoting motion of leg member 104 about connection 103, thereby causing engaging means 102*a* in association with leg member 104 to lockingly engage engaging means 102*b* in association with the distal end 122 of boom 120. The pivoting motion of leg member 104 about connection 103 results because leg member 104 is responsive to operation of lift means 106, having the further advantage that no independent vertical assist means is necessary to lift distal end 122, which results from the longitudinal and vertical movement of boom 120 causing pivoting motion of leg member 104 so as to raise the distal end 122 of boom 120.

A person of skill in the art of machine design would understand that stationary base 12 may be replaced by base 110 to implement a mobile version of system 10.

Figure 2:
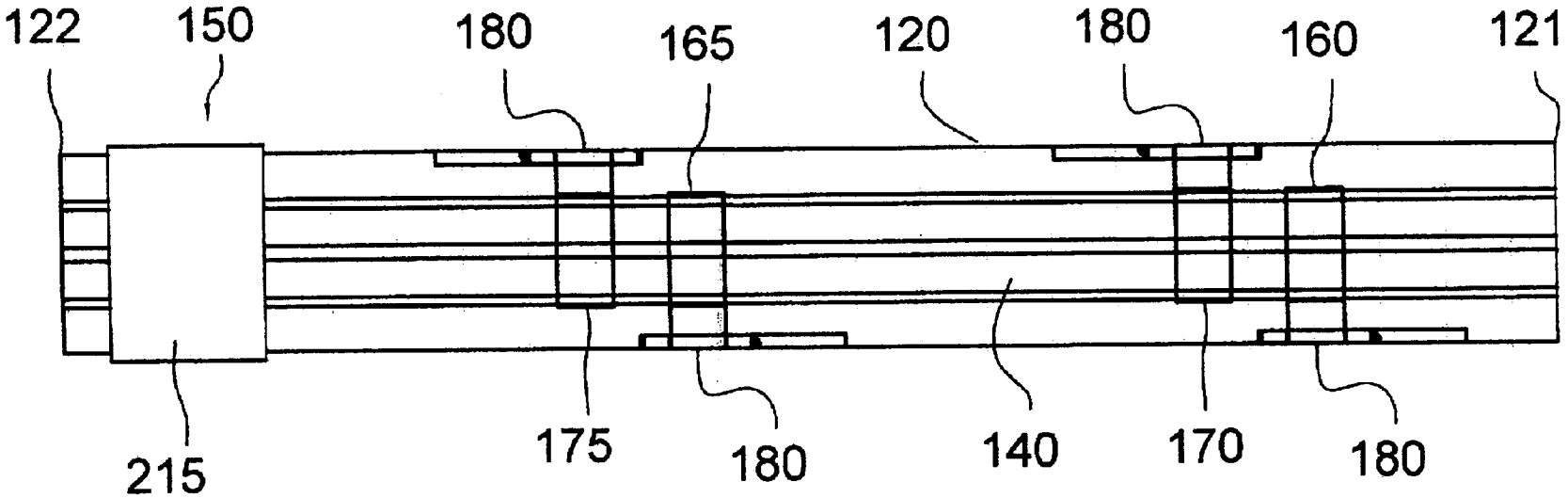
FIG. 2 is a top view of select elements of the apparatus shown in FIG. 1.

Referring to FIG. 2 there is illustrated a top view of boom 120 including first ejector pair 160 and 165 each adapted to pivot about a pivot 180 relative to one side of boom 120. Further included is the second ejector pair 170 and 175 each ejector adapted to pivot about a pivot 180 relative to an opposing side of boom 120. As at ejector 160, each pivot 180 may comprise any suitable assembly, however according to one embodiment a thick-walled tube is attached to or formed in cradle member 161 (see FIG. 3) permitting the use of any suitable pin to hingedly attach ejector 160 to a side of boom 120. As carriage assembly 150 moves distally from proximal end 121 having pipe 148 (not shown) carried in receiving area 215, once carriage assembly 150 nears distal end 122 of boom 120 substantially all of pipe 148 will lay in trough 140 across both ejector pair 160 and 165 and ejector pair 170 and 175, whereupon if ejector pair 160 and 165 activates, then pipe 148 will be ejected from trough 140 to one side of boom 120 and if instead ejector pair 170 and 175 activates, then pipe 148 will be ejected from trough 140 to an opposing side of boom 120. All pivots 180 are adapted to permit carriage assembly 150 to pass thereover without interfering with the motion of carriage assembly 150. A person of skill in the art of machine assembly would understand that according to a preferred embodiment of system 100 cradle member 161 (see FIG. 3) of ejector 160 may be cut from trough 140 after trough 140 has been formed and fastened to boom 120, thereby ensuring that the cross-sections of cradle member 161 and trough 140 substantially conform to one another in order to reduce the risk of interference (at the joints there between) with the passage of carriage assembly 150 over ejector 160 enroute to either proximal end 121 or distal end 122.

Figure 3:
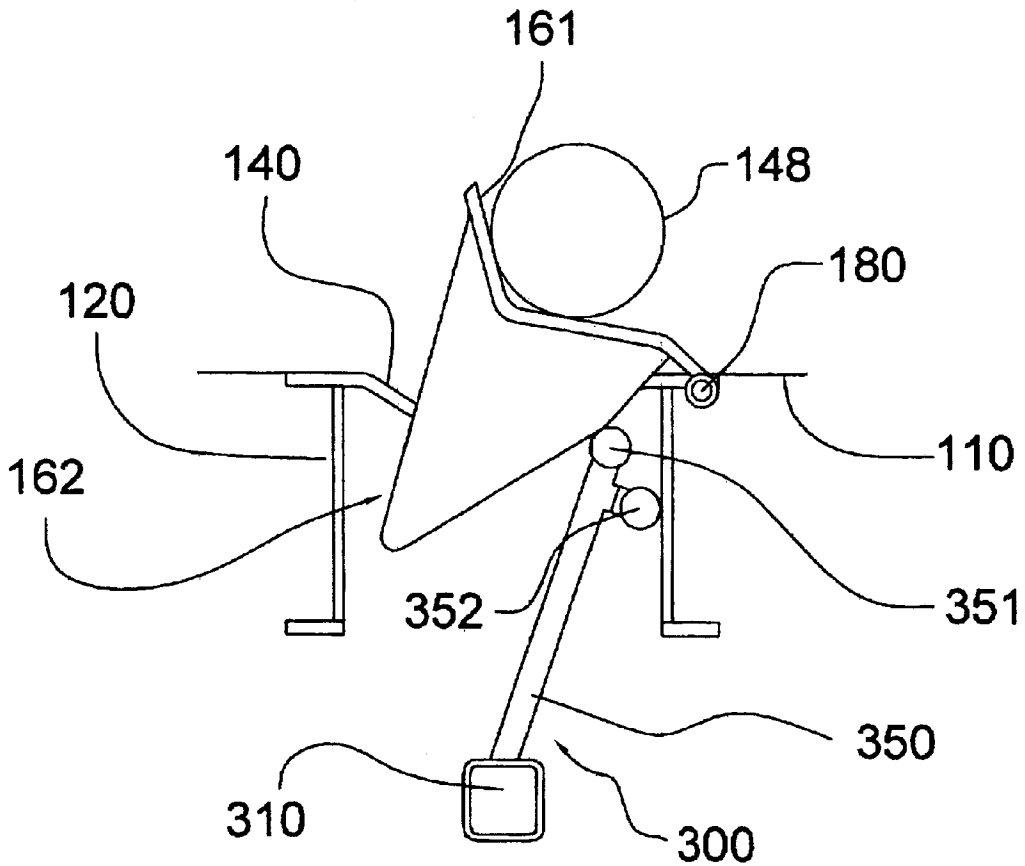
FIG. 3 is an enlarged view of an ejector of the apparatus of the present invention.

Referring to FIG. 3 there is illustrated a cut-away end-view of ejector 160 partially activated by actuation means 300 wherein actuator shaft 310 has been moved to an activated position such that actuator member 350 and striker 351 thereon can contact receiver assembly 162 (fastened to the underside of cradle member 161) as boom 120 lowers into cavity 115 (not shown) the interference of actuator member 350 and striker 351 with receiver assembly 162 forces cradle member 161 to pivot about pivot 180 ejecting pipe 148 from trough 140. A person of skill in the art of machine design would understand that the size, shape and position of each of receiver assembly 162 and actuator member 350 with striker 351 are relative to one another as well as to the distance between first ejector 160 and second ejector 165. There are many sizes, shapes, and relative positionings of ejectors and actuators that will work on the principle of a passive actuator member interfering with a suitably positioned, pivotally connected ejector so as to cause such ejector to pivot about such connection. Optional striker 352 limits the radial motion of actuator member 350 and reduces wear against base 120.

According to one embodiment of actuation means 300, actuator shaft 310 is rotated into its activated position prior to ejector 160 being lowered into the zone in which ejector 160 can be interfered with by actuator member 350. According to an alternate embodiment of actuation means 300, actuator shaft 310 may slide longitudinally into position prior to ejector 160 being lowered into the zone in which it can be interfered with by actuator member 350. According to a further alternate embodiment of actuation means 300, actuator shaft 310 may rotate laterally into position after ejector 160 has been lowered into the zone in which it can be interfered with by actuator member 350. According to a further alternate embodiment of actuation means 300, actuator shaft 310 may slide longitudinally into position after ejector 160 has been lowered into the zone in which it can be interfered with by actuator member 350. According to a further alternate embodiment of actuation means 300, actuator shaft 310 may be moved either slidingly or rotatingly causing actuator member 350 to be positioned either prior or after ejector 160 has been lowered into a zone in which it is both laterally and longitudinally aligned with actuator member 350, and actuator member 350 comprises a telescoping member such that striker 351 is moved, toward receiver assembly 162 on ejector 160, when actuator member 350 extends by any suitable (e.g. hydraulic ram, electrically driven worm gear) telescoping action a distance that permits ejector 160 to activate substantially simultaneously with ejector 165 in order that ejector pair 160 and 165 eject pipe 148 from trough 140 in a manner that allows pipe 148 to roll safely onto base 110 or to any suitable integrated dumping assembly included therein.

Advantageously, trough 140 has a substantially v-shaped cross-section that tolerates a "pitch and roll" of approximately 30 degrees at the same time as facilitating pipe 148 "finding center" and resting stably in trough 140 rather than rocking back and forth (before coming to rest) as it would tend to do in a conventional trough having a substantially circular cross-section.

Figure 4:
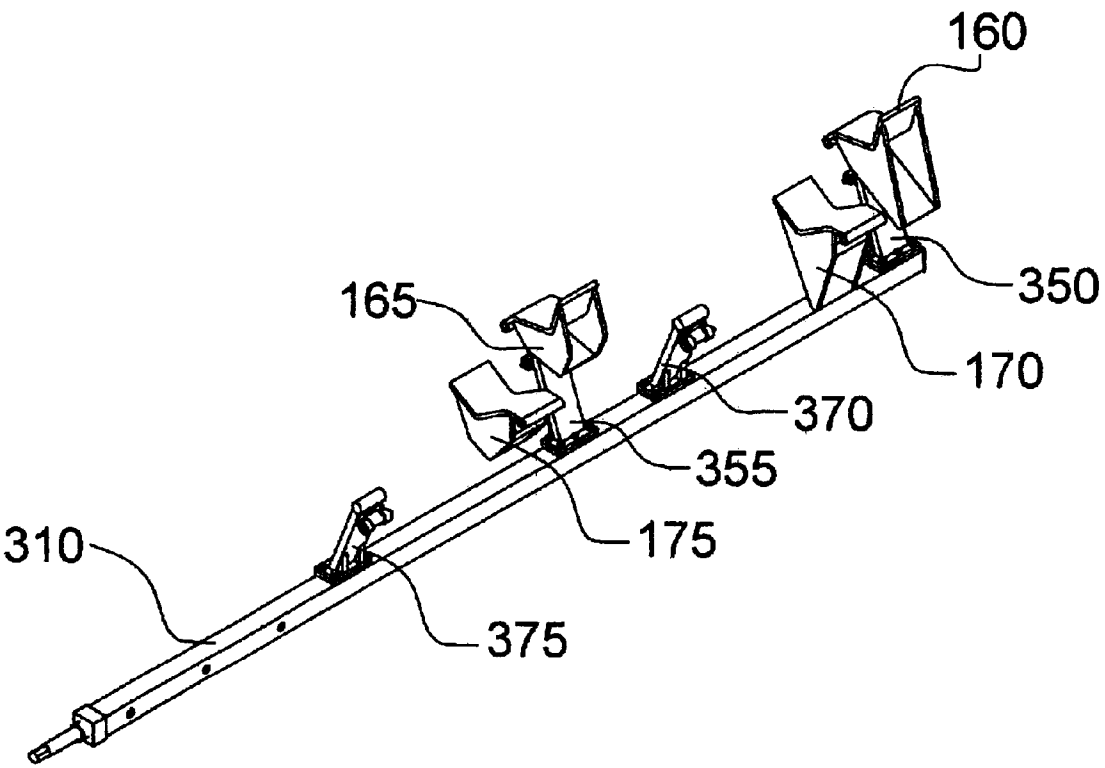
FIG. 4 is a perspective view of one embodiment of an actuator shaft and actuator members of the ejection apparatus of the present invention.

Referring to FIG. 4 there is illustrated a perspective view of one bi-directional embodiment of actuation means 300 comprising a single actuator shaft 310 to which actuator members 350 and 355 are fastened for the purpose of interfering with ejectors 160 and 165 respectively for ejecting pipe 148 from trough 140 to one side of boom 120. Further comprising actuator members 370 and 375 fastened to actuator shaft 310 for the purpose of interfering with ejectors 170 and 175 respectively, for ejecting pipe 148 to an opposing side of boom 120. A person of skill in the art would understand that actuator members 350, 355, 370 and 375 may be reoriented and/or reshaped to operate with their respective ejectors adapted to activation resulting from either the rotational or longitudinal sliding movement of actuator shaft 310.

Figure 6:
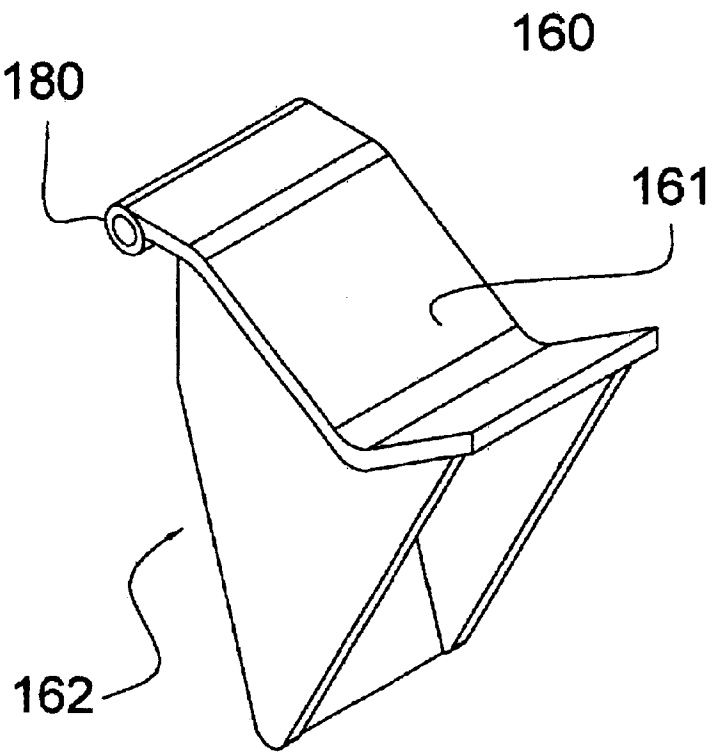
FIG. 6 is an isometric view of one embodiment of a proximal ejector of the present invention.
Figure 5:
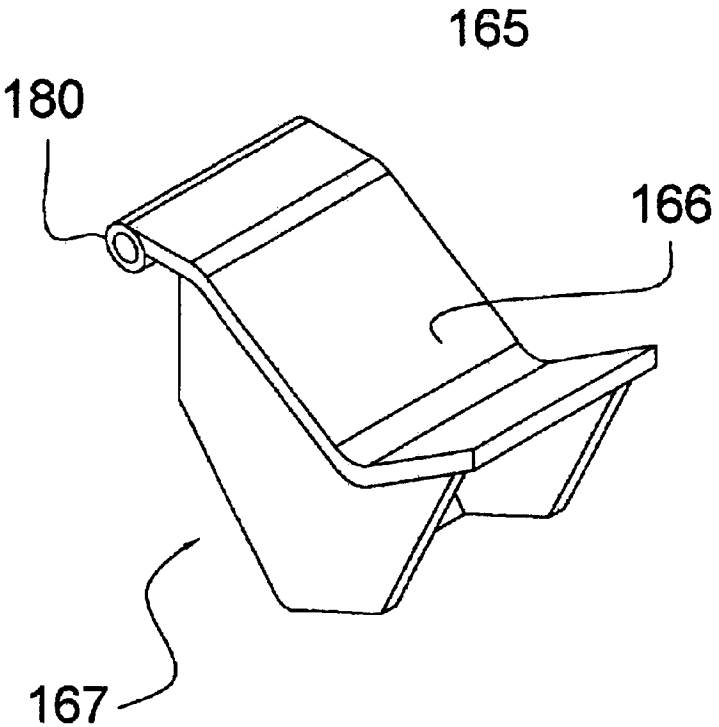
FIG. 5 is an isometric view of one embodiment of a distal ejector of the present invention.

Referring to FIG. 5 there is illustrated an embodiment of ejector 165 being the ejector paired with and situate distally of and longitudinally isolated from ejector 160 shown in FIG. 6. As shown, ejectors 160 and 165 each have pivots 180 for any suitable pin coupling to boom 120 at their respective locations. Ejectors 160 and 165 further have respectively cradle members 161 and 166 that according to a preferred embodiment are the same size and shape. However a person of skill in the art of machine design would understand that receiver assembly 162 although directly related to receiver assembly 167 will differ therefrom in a manner and to an extent that depends upon the relative positions of ejectors 160 and 165 as well as the absolute size of one or the other of the operationally matched ejector pair, since although ejectors 160 and 165 must be longitudinally isolated from one another, their activation is synchronized in order to ensure the safe ejection of pipe 148 from trough 140.

Figure 7:
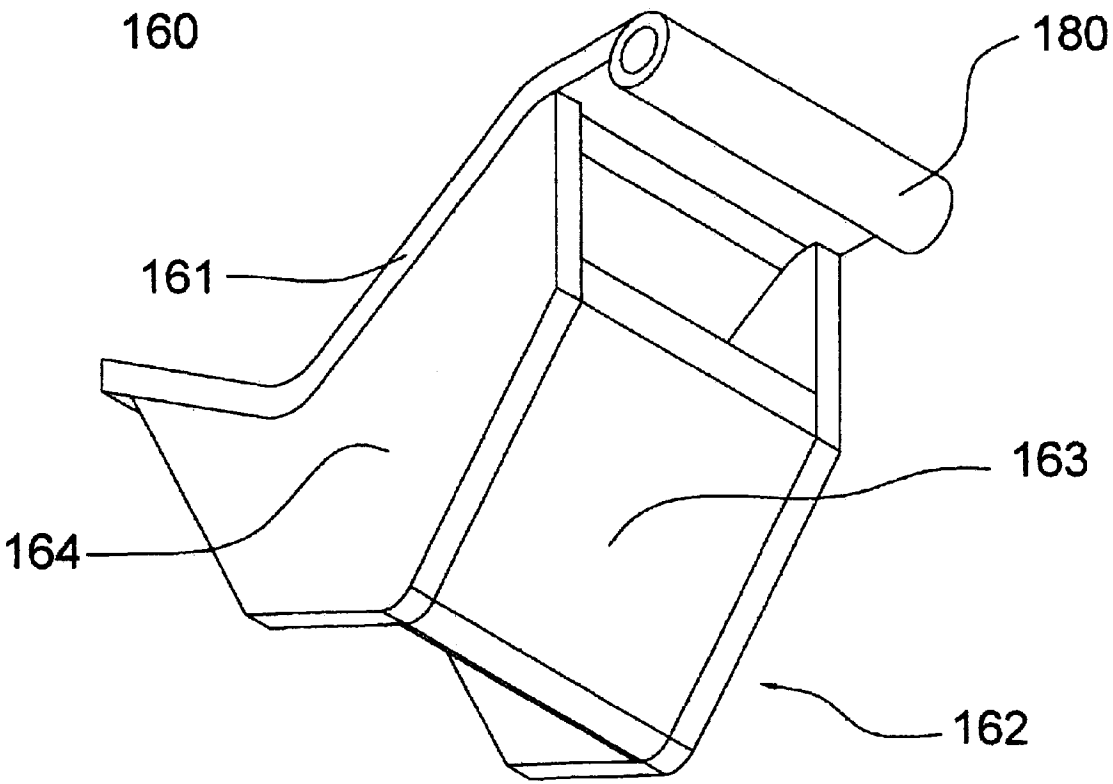
FIG. 7 is a perspective view of one embodiment of a receiver assembly of an ejector of the present invention.

Referring to FIG. 7 there is illustrated a perspective view of the underside of ejector 160 showing one embodiment of receiver assembly 162 fastened typically by welding to the underside of cradle member 161, that conforms to trough 140, further having one embodiment of pivot 180 shown as a thick-walled tube through which a pivot pin (not shown) may be inserted for the purpose of coupling ejector 160 to boom 120. A person of skill in the art of machine design would understand that receiver assembly 162 may comprise a flat plate 163, across which striker 351 rolls as actuator member 350 engages ejector 160, or it may comprise a pocket (not shown) formed by receiver sides 164 into which a portion of actuator member 350 is inserted—in either case to cause ejector 160 to activate. Although as shown receiver assembly 162 is configured for longitudinal alignment with and lateral engagement by actuator member 350, it is contemplated that by repositioning and reshaping plate 163, across the bottoms of sides 164, to permit engagement of actuator member 350 with receiver assembly 162 in order to cause the activation of ejector 160 by either rotating or sliding actuator shaft 310. A person of skill in the art would further understand the need to suitably reinforce pivot 180 and to orient plate 163 such that ejector 160 can pivot nearly perpendicular to the activating motion.

Figure 8:
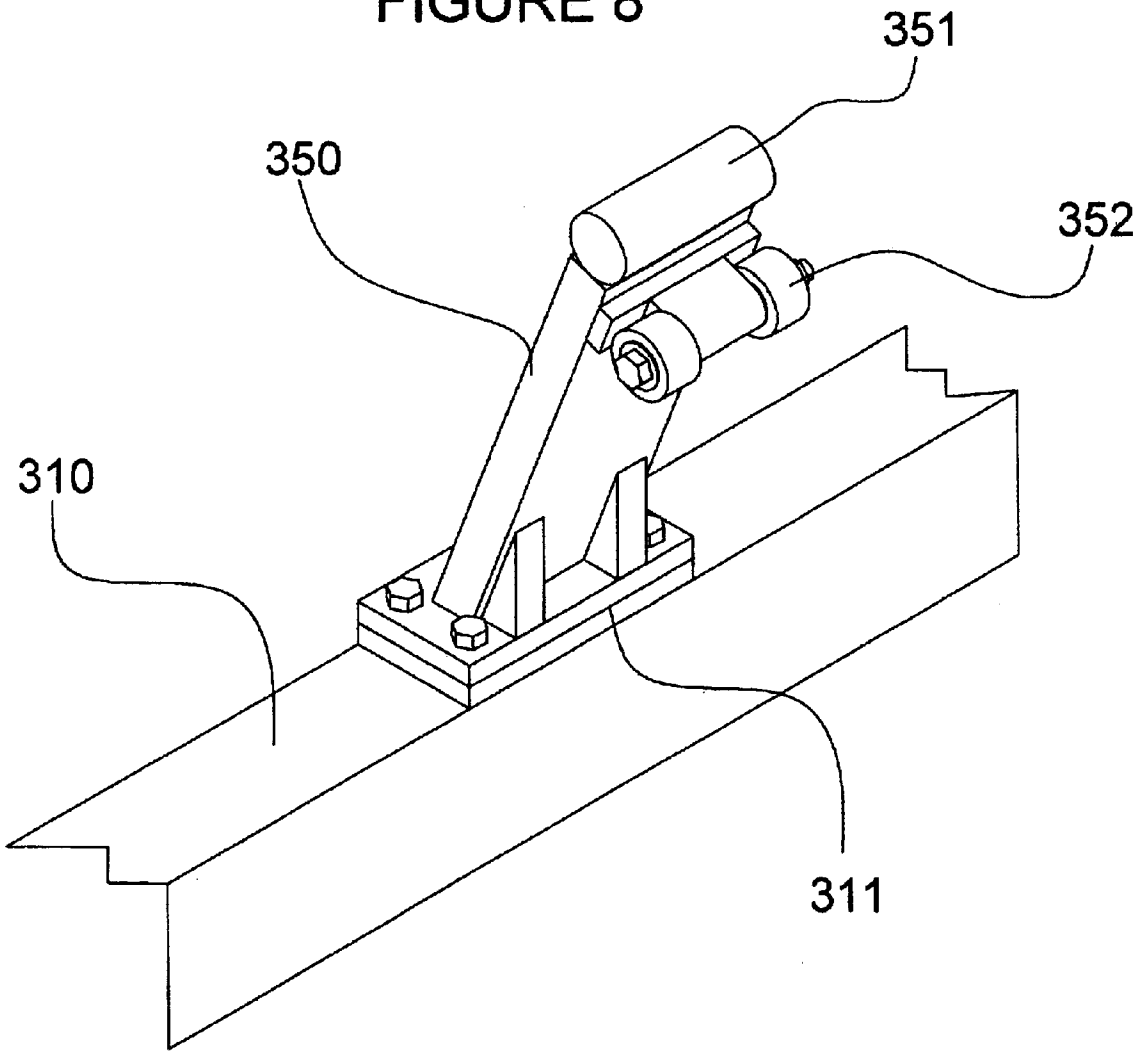
FIG. 8 is a perspective view of one embodiment of an actuator member element.

Referring to FIG. 8 there is illustrated a perspective view of one embodiment of actuator member 350 fastened at its base 311 to actuator shaft 310. According to one embodiment actuator member 350 comprises a rigid elongate member of any suitable dimension and material. Strikers 351 and 352 may each be of either the fixed or rolling variety and sized according to the ejector and base that they are respectively designed to engage. A person of skill in the art would understand that all actuator members may be of the same specifications while all ejectors have specifications that are unique to their locations, or vice versa, all ejectors may be of substantially the same specifications while each actuator member is customized to its particular location and relative to the location of its mate. According to an alternate embodiment actuator member 350 may comprise an hydraulic ram permitting striker 351 to telescopically extend radially away from actuator shaft 310 for the purpose of permitting ejector 160 to be activated in the laid down position even if boom 120 has not been raised to permit the movement of actuator shaft 310 to an activated position.

The terms and expressions employed in this specification are used as terms of description and not of limitation, and there is no intention in the use of such terms and expressions to exclude any equivalents of the features shown and described or portions thereof, and it is recognized that various modifications are possible within the scope of the invention claimed. Although the disclosure describes and illustrates various embodiments of the invention, it is to be understood that the invention is not limited to these particular embodiments. Many variations and modifications will now occur to those skilled in the art of machine design and drill pipe handling. For full definition of the scope of the invention, reference is to be made to the appended claims.

We claim:

1. A pipe handling apparatus capable of laterally ejecting pipe, said apparatus having a base, said base having a longitudinally extending cavity therein, said apparatus further having longitudinally extending boom means having a distal end and a proximal end, a first side and a second opposing side, and a longitudinally extending trough for receiving at least one section of pipe, further comprising:

a first ejector pivotally coupled to said first side of said boom means;

a second ejector, longitudinally separated along said boom means from said first ejector and pivotally coupled to said first side of said boom means;

actuator shaft means situate below and substantially parallel to said boom means movably coupled to said base, said actuator shaft means having an actuated position, together with means for moving said actuator shaft means to said actuated position;

wherein said actuator shaft means may be moved to said actuated position to enable substantially simultaneous activation of said first and second ejectors so as to cause said pipe to be ejected from said first side of said boom means.

2. The apparatus as claimed in claim 1 further comprising:

a third ejector, situate proximate said first ejector, pivotally coupled to said second opposing side of said boom means, said first and second ejectors forming a first ejector pair; and a fourth ejector, situate proximate said second ejector, pivotally coupled to said second side of said boom means, said third and fourth ejectors forming a second ejector pair;

said actuator shaft means having a first actuated position and a second actuated position, together with means for moving said actuator shaft means between said first and second actuated positions;

wherein said actuator shaft means may be moved to said first actuated position to activate said first ejector pair so as to eject pipe from said first side of said boom means and may be moved to said second actuated position to activate said second ejector pair so as to eject pipe from said second side of said boom means.

3. The apparatus as claimed in claim 1 wherein said actuator shaft means comprises:

an elongate shaft member;

a first actuator member extending radially from said shaft member and substantially in longitudinal alignment with said first ejector; and a second actuator member extending radially from said shaft member and substantially in longitudinal alignment with said second ejector;

whereby, when said actuator shaft means is moved to said actuated position said first actuator member can engage said first ejector and substantially simultaneously said second actuator member can engage said second ejector.

4. The apparatus as claimed in claim 2 wherein said actuator shaft means comprises:

an elongate shaft member;

a pair of first actuator members extending radially from said shaft member and substantially in alignment respectively with said first and second ejectors of said first ejector pair; and a pair of second actuator members extending radially from said shaft member and substantially in alignment respectively with said first and second ejectors of said second ejector pair;

wherein said elongate shaft member may be moved to a position whereby said pair of first actuator members engage respectively said first and second ejectors of said first ejector pair so as to eject pipe from said first side of said boom means, and said elongate shaft member may be moved to a position whereby said pair of second actuator members engage respectively said first and second ejectors of said second ejector pair so as to eject said pipe from said second side of said boom means.

5. The apparatus as claimed in claim 2 wherein said actuator shaft means comprises:

an elongate shaft member;

a pair of first actuator members extending radially from said shaft member and substantially in alignment respectively with said first and second ejectors of said first ejector pair; and a pair of second actuator members extending radially from said shaft member and substantially in alignment respectively with said first and second ejectors of said second ejector pair;

wherein said elongate shaft member may be moved to a position whereby said pair of first actuator members engages respectively said first and second ejectors of said first ejector pair so as to, when said boom means is lowered into said cavity, eject pipe from said first side of said boom means, and said elongate shaft member may be moved to a position whereby said pair of second actuator members engages respectively said first and second ejectors of said second ejector pair so as to, when said boom means is lowered into said cavity, eject said pipe from said second side of said boom means.

6. The apparatus as claimed in claim 2 wherein said actuator shaft means comprises:

a first elongate shaft member having a first actuator member extending radially therefrom and substantially in longitudinal alignment with said first ejector;

a second actuator member extending radially from said first elongate shaft member and substantially in longitudinal alignment with said second ejector;

a second elongate shaft member having a third actuator member extending radially therefrom and substantially in longitudinal alignment with said third ejector; and a fourth actuator member extending radially from said second elongate shaft member and substantially in longitudinal alignment with said fourth ejector;

wherein said first elongate shaft member may be moved to a position whereby said first actuator member engages said first ejector and substantially simultaneously said second actuator member engages said second ejector, so as to eject pipe from said first side of said boom means, and alternatively said second elongate shaft member may be moved to a position whereby said third actuator member engages said third ejector and substantially simultaneously said fourth actuator member engages said fourth ejector, so as to eject pipe from said second side of said boom means.

7. The apparatus as claimed in claim 2 wherein said actuator shaft means comprises:

a first elongate shaft member having a first actuator member extending radially therefrom and substantially in longitudinal alignment with said first ejector;

a second actuator member extending radially from said first elongate shaft member and substantially in longitudinal alignment with said second ejector;

a second elongate shaft member having a third actuator member extending radially therefrom and substantially in longitudinal alignment with said third ejector; and a fourth actuator member extending radially from said second elongate shaft member and substantially in longitudinal alignment with said fourth ejector;

wherein said first elongate shaft member may be moved to a position whereby said first actuator member engages said first ejector and substantially simultaneously said second actuator member engages said second ejector, so as to, when said boom means is lowered into said cavity, eject pipe from said first side of said boom means, and alternatively said second elongate shaft member may be moved to a position whereby said third actuator member engages said third ejector and substantially simultaneously said fourth actuator member engages said fourth ejector, so as to, when said boom means is lowered into said cavity, eject pipe from said second side of said boom means.

8. The apparatus as claimed in claim 4 wherein each of said first and second ejector of said first ejector pair comprises:

pivot means for pivotally coupling said first ejector pair to said first side of said boom means; and a receiver assembly for engaging one actuator member of said pair of first actuator members;

wherein each said receiver assembly of said first ejector pair is positioned, shaped, and sized so as to enable said pair of first actuator members to substantially simultaneously pivot said first and second ejectors of said first ejector pair.

9. The apparatus as claimed in claim 4 wherein each of said first and second ejector of said second ejector pair comprises:

pivot means for pivotally coupling said second ejector pair to said second side of said boom means; and a receiver assembly for engaging one actuator member of said pair of second actuator members;

wherein each said receiver assembly of said second ejector pair is positioned, shaped, and sized so as to enable said pair of second actuator members to substantially simultaneously pivot said first and second ejectors of said second ejector pair.

10. The apparatus as claimed in claim 8, further having cradle means, wherein said cradle means comprises a cradle member having a generally v-shaped cross-section further having a cradle surface situated co-planar with and conforming to said trough, said cradle member laterally extending across an opening in said trough between first and second sides thereof, said cradle member having a first edge and a second edge respectively coincident with said first and second sides of said boom means, said cradle member pivotally coupled, by said pivot means fastened on one of said first and second edges of said cradle member, to one side of said boom means for permitting said ejector to pivot about one side of said boom means so as to allow pipe therein to exit said cradle member when said ejector pair is activated.

11. The apparatus as claimed in claim 10, wherein said pivot means for pivotally coupling each said ejector to said boom means comprises:

a pivot tube connected to one of said first and second edges of said cradle member;

at least one fixed tube fastened to one side of said boom means situate proximate to and axially aligned with but longitudinally displaced from said pivot tube, and a pivot pin positioned on a common axis so as to releasably couple said pivot tube to said at least one fixed tube, about which pin the attached ejector can pivot transversely relative to said boom means.

12. The apparatus as claimed in claim 8 wherein said receiver assembly comprises a rigid surface against which a respective actuator member may be engaged so as to permit the application of force to said rigid surface so as to cause said first and second ejector to respectively pivot about said pivot means, each said rigid surface being situated, oriented, shaped, and sized so as to enable said pair of first actuator members to substantially simultaneously pivot said first and second ejectors of said first ejector pair.

13. The apparatus as claimed in one of claims 3–7 wherein each said actuator member comprises an elongate cam relatively situated, oriented, shaped, and sized so as to transmit force against said receiver assembly for the purpose of substantially simultaneously activating a pair of ejectors.

14. The apparatus as claimed in claim 13 wherein said elongate cam further comprises a coupling end and an opposing striking end together with means for retractably telescoping said striking end radially away from said actuator shaft member, said means for retractably telescoping being to permit the activation of said ejectors even while said boom means is nested in said cavity.

15. The apparatus as claimed in claim 1 or 2 wherein the movement of said actuator shaft means is rotational.

16. The apparatus as claimed in claim 1 or 2 wherein said actuator shaft means is slidably moveable in a longitudinal direction.

17. The apparatus as claimed in any one of claims 3–7 wherein said elongate shaft member moves rotationally.

18. The apparatus as claimed in any one of claims 3–7 further comprising hydraulic assist means to assist movement of said elongate shaft member.

* * * * *